United States Patent [19]

Morgan et al.

[11] Patent Number: 4,850,806

[45] Date of Patent: Jul. 25, 1989

[54] CONTROLLED BY-PASS FOR A BOOSTER PUMP

[75] Inventors: Steven V. Morgan, Windsor; John E. Madocks, Oakland, both of Calif.

[73] Assignee: The BOC Group, Inc., Murray Hill, New Providence, N.J.

[21] Appl. No.: 197,937

[22] Filed: May 24, 1988

[51] Int. Cl.[4] ..... F04B 23/12

[52] U.S. Cl. ..... 417/53; 417/62; 417/205; 417/250; 417/253

[58] Field of Search ..... 417/205, 253, 250, 251, 417/252, 286, 287, 199.1, 201, 206, 62, 69, 53

[56] References Cited

U.S. PATENT DOCUMENTS

| | | | |
|---|---|---|---|
| 2,492,075 | 12/1949 | Van Atta | 417/62 |
| 3,446,422 | 5/1969 | Bailleul-Langlais | 417/199.1 |
| 4,504,194 | 3/1985 | Holden | 417/53 |
| 4,505,647 | 3/1985 | Alloca | 417/252 |

FOREIGN PATENT DOCUMENTS

| | | | |
|---|---|---|---|
| 535738 | 4/1941 | United Kingdom | 417/253 |

OTHER PUBLICATIONS

Roots Rotary Lobe Blowers RAS-RGS, Dresser Industries, Inc. Bulletin IRB-201-784, 1984.

*Primary Examiner*—Leonard E. Smith

*Attorney, Agent, or Firm*—David A. Draegert; Larry R. Cassett

[57] ABSTRACT

A method and apparatus for evacuating an enclosed chamber which utilizes a tandem connection of a booster pump and a mechanical pump in a manner to maximize the rate of evacuation of the chamber but without exceeding the rating of the booster pump and damaging it. A gas bypass around the booster pump is provided with a proportional valve that is operated to start an evacuation of the chamber with the bypass path fully opened but the gradually closing that path in a manner to maintain a differential pressure across the booster pump at a predetermined level, until the bypass path has been fully closed.

10 Claims, 4 Drawing Sheets

CONTROLLED BY-PASS FOR A BOOSTER PUMP

BACKGROUND OF THE INVENTION

This invention relates generally to air or other gas pump operation and control, specifically to the operation and control of a booster (blower) type of pump.

There are many applications in industrial processes and systems wherein it is necessary to evacuate an enclosed chamber to reduce its air pressure a great deal. One such industrial process is the coating of substrates with thin films by sputtering, use of plasma, and the like, which must be accomplished at a very low air pressure. At least a portion of a chamber in which such deposition occurs needs to be opened to the atmosphere around it so that substrates can be moved into and out of the processing chamber. Each time the chamber, or portion thereof, is open to the atmosphere, it must again be evacuated. It is desirable that this evacuation be accomplished as quickly as possible in order to increase the rate at which substrates are coated.

A usual technique for evacuating a chamber in this and other industrial processes and machines is to use a tandem connection of a booster pump (blower) and a mechanical pump. The mechanical pump evacuates the chamber through the booster pump. The purpose of the booster pump is to assist the mechanical pump in evacuating the chamber faster and to a lower pressure than might be possible with the mechanical pump alone. However, the construction of such a booster pump usually compels operating it within limiting operational parameters in order to avoid damaging the pump. A common type of pump is a Roots rotary lobe blower. This type of pump should not be operated with a differential pressure across it that exceeds a certain level, that level usually being established by the manufacturer of the pump. If such a pump is operated for a significant period with a pressure difference that exceeds the recommended limit, damage occurs in the form of seals and/or bearings failing, or by damage to fragile rotating impellers by their hitting the pump's housing. Therefore, in order to avoid costly repairs to a booster pump, with an accompanying down time of the industrial equipment with which the pump is used, such booster pumps are operated within the prescribed pressure difference limit. However, in doing so, the rate in which the chamber can be evacuated is also limited.

One way that is utilized to control the pressure difference across a booster pump is to provide a bypass from its inlet to its outlet that is controlled with a valve. The bypass valve is normally closed when the booster pump is operating in a normal manner but is fully opened to reduce the pressure difference across the pump when operating under conditions that would cause the prescribed pressure difference limit to be exceeded without a bypass. Such a condition occurs when the evacuation of a chamber at atmospheric pressure is commenced.

One specific implementation of the bypass technique (Airco Solar) is to commence such evacuation with the bypass valve open, and keep the valve open until the absolute pressure in the bypass path falls below a limit where, from experience, it is known that a resulting rapid increase in pressure across the booster pump resulting from closing the valve will not exceed the prescribed limit. Once the bypass valve has been closed, it remains closed until the chamber is evacuated to the desired pressure level.

Another specific technique (Pfeiffer) is to delay starting the booster pump until the mechanical pump has drawn the pressure within the evacuated chamber to something less than atmospheric pressure. The booster pump is then operated to join with the mechanical pump in reducing the pressure within the chamber to its desired end point. The booster pump also has a bypass with a relief valve normally closing the bypass. The relief valve opens when the differential pressure across the booster pump exceeds a prescribed limit. The relief valve is a safety device in case the operation of the booster pump otherwise causes the pressure difference across the booster pump to significantly exceed its prescribed limit.

Yet another implementation of the bypass technique (Leybold-Heraeus) also includes a bypass path around the booster pump and a check valve normally closing off that path. As in the immediately preceding described technique, the relief valve is forced open when the booster pump pressure difference exceeds a certain level. The difference here is that when the evacuation of a chamber is commenced, the booster pump is fully operable. This results in the relief valve opening almost immediately upon commencement of pumping of air or other gas from the chamber. But before such a valve is able to respond, the booster pump experiences a sharp, short and high spike of pressure difference which is not desirable. The bypass valve then remains open until the absolute pressure within the bypass path is reduced to a predetermined level at which time it is closed to eliminate the bypass path during the rest of the chamber evacuation process.

Another technique (Edwards), which can be used either with or without such a valve bypass, is to drive the booster pump through a fluid coupling. When the pressure difference across the booster pump increases, the load on its driving motor increases. The fluid coupling allows slippage to occur so that the booster pump slows down, thereby reducing the pressure difference across it. This form of self-correction also occurs when an A.C. non-synchronous electric motor of a direct mechanically driven booster pump is undersized.

It is a primary object ot the present invention to provide an improved technique for controlling the pressure difference across a booster pump in a manner to maintain the wear of the pump within acceptable limits while maximizing the rate at which a chamber may be evacuated of air or other gas.

SUMMARY OF THE INVENTION

This and additional objects are accomplished by the various aspects of the present invention, wherein, briefly, an enclosed chamber is evacuated by a tandem connection of a booster pump (blower) and a mechanical pump, a bypass path being provided around the booster pump with a proportional valve that operates as the chamber is being evacuated to maintain the pressure difference across the pump at a determined optimum fixed level that is at or slightly below the prescribed maximum limit of pressure difference for that booster pump. According to a specific aspect of the present invention, the bypass valve is initially open when the evacuation of the chamber is commenced by driving both of the series connected pumps. Shortly after evacuation of the chamber has commenced, closing of the bypass valve begins. This closing continues at a rate that maintains the pressure differential across the booster pump at the desired, substantially constant level, as part of a servo control loop, until the bypass valve is completely closed. The pumps then continue to evacuate the chamber until the pressure within it is at a desired level. The booster pump is driven by its motor source at a near constant speed throughout the evacuation process.

By sensing the differential pressure across the booster pump to proportionately control the amount of gas that is bypassed around the booster pump during a beginning portion of the evacuation of a chamber that is initially at atmospheric pressure, the booster pump works at its prescribed limit of pressure difference over more of the evacuation cycle than the techniques described above as background. This results in the evacuation cycle being made significantly shorter. The booster pump is operated at its maximum practical level during a greater part of the cycle. The cycle is also shortened by not allowing the blower to slow down any significant amount under the load of the prescribed maximum differential pressure. This slowdown is avoided by driving the booster pump through a direct mechanical connection with an electric motor that is sufficiently sized to carry that load.

Additional objects, features and advantages of the present invention will become apparent from the following description of its preferred embodiment, which description should be taken in conjunction with the accompanying drawings.

DESCRIPTION OF PREFERRED EMBODIMENTS

Figure 1:
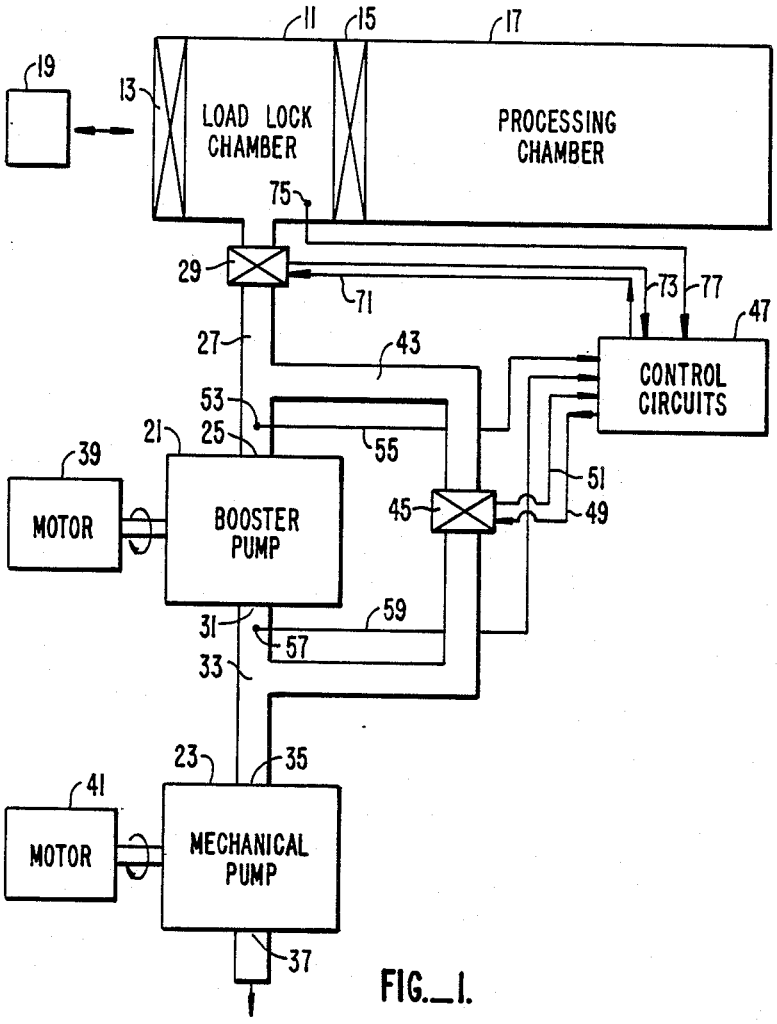
FIG. 1 schematically illustrates a pumping system utilizing the various aspects of the present invention.

The improved pumping system and method of the present invention are described herein, with respect to the drawings, in two exemplary embodiments. Referring to FIG. 1, a first embodiment is described. An enclosable load lock chamber 11 includes a load lock valve 13 for opening the chamber 11 into the atmosphere. Another load lock valve 15 is provided for opening the chamber 11 into a processing chamber 17. The processing chamber 17 is maintained evacuated by an appropriate pumping system (not shown). The type of processing that is carried on in the chamber 17 is that which requires a very low air pressure in order to operate properly. An example article 19, to be moved into and out of the chamber 17 for processing, is passed through the load lock chamber 11 in a manner that does not expose the chamber 17 to the outside atmospheric pressure. This is accomplished by keeping the load lock valve 15 closed while the load lock valve 13 is opened to the outside so that the article 19 can be moved into or out of the load lock chamber 11.

When the article 19 is being moved into the processing chamber 17, it is first positioned into the load lock chamber 11 with both of the load lock valves 13 and 15 being closed. The chamber 11 is then evacuated from the atmospheric pressure to which it was exposed when the load lock valve 13 was opened, to approximately the same low air pressure as existing in the processing chamber 17. This is accomplished by the pumping system and method to be described. Once the load lock chamber 11 has been so evacuated, the load lock valve 15 is opened and the article 19 then moved from the chamber 11 to the chamber 17 for processing. Processing is commenced once the load lock valve 15 is again closed. When processing of the article 19 is completed, it is moved back into the evacuated chamber 11 by opening the valve 15. The valve 15 is then closed and the valve 13 opened to extract the processed article 19 from the chamber 11. The chamber 11 has now been exposed to atmospheric pressure so that the valve 13 must be closed and the chamber 11 pumped down before the load lock valve 15 can again be opened. Alternative to the use of a single load lock chamber 11 for both entry and exit of articles, a second load lock chamber is often provided at the opposite end of the processing chamber 17 so that the article can be loaded into the chamber 17 from one end and taken out of the chamber 17 from its other end.

An example of an industrial processing using such equipment is a glass coater. In such an application, the article 19 is a sheet of formed automobile glass, such as windshield, or a building window (architectural glass). The processing that is carried on in the chamber 17 is to coat the glass substrate with one or more thin films to provide various functional and decorative effects. The thin films are typically applied by a sputtering or plasma deposition process.

The load lock chamber 11 for such an item of machinery has a large volume which needs to be evacuated rapidly from atmospheric pressure to a low pressure of in the vicinity of $1.0\times10^{-1}$ Torr to $1.0\times10^{-3}$ Torr for such processes. Since the equipment is sized to cause this large change of pressure, the differential pressure across the booster pump 21 will likely greatly exceed its permitted level at the beginning of a cycle unless somehow controlled. The faster that this evacuation can be accomplished, the higher the rate of processing articles becomes. Typically, the basic evacuation apparatus includes two tandem connected pumps, a booster pump 21 and a mechanical pump 23. An intake 25 of the booster pump 21 is connected by a pipe 27 to the load lock chamber 11 through a roughing valve 29. The purpose of the valve 29 is to seal off the load lock chamber 11 after it has been evacuated.

A discharge 31 of the booster pump 21 is connected by piping 33 to an intake 35 of the mechanical pump 23. The mechanical pump has a discharge 37 that is exhausted to the atmosphere. The booster pump 21 is driven by an electric motor 39. The mechanical pump 23 is driven by an electric motor 41.

The mechanical pump 23 is usually of a piston or rotary vane type. The booster pump 21 is usually a rotary lobe blower type, such as that known as a Roots blower. Because of the construction of this type of blower, the pressure differential between its intake 25 and discharge 31 must be maintained below a certain level, generally established by the manufacturer, in order to avoid premature failure. In a typical tandem pump system as shown in FIG. 1, the pressure differential across the booster pump 21 will significantly exceed such a level at the initial stages of pumping down the load lock chamber 11 from an initial atmospheric pressure. Therefore, it is typical to provide a bypass pipe 43 between the intake 25 and discharge 31 of the booster pump, as described previously. Such a bypass path 43 utilizes a valve 45 therein in order to open or close the bypass path. When open, the bypass path tends to equalize the pressure at the intake and discharge of the booster pump 21, but this, of course, reduces the effectiveness of the pump. When the bypass path 45 is closed, the booster pump 21 is operating at full capacity. As discussed previously, the bypass valve 45 of prior art systems is only capable of either being held fully open or fully closed.

The valve 45 in the system according to the present invention, however, is chosen to be a proportional valve. Such a valve can be partially opened (or closed). The pumping system of FIG. 1 includes control circuits 47 that sends an electrical signal over circuit 49 to tell the valve 45 whether it should be fully open, fully closed, or held at some intermediate, partially opened position. Circuits 51 optionally communicate with control circuits 47 the position of the valve 45.

According to the present invention, the pressure difference across the booster pump 21 is monitored and, in this embodiment, electrical signals proportional thereto utilized by the control circuits 47 to optimally control the opening of the bypass valve 45 during the evacuation of the load lock chamber 11. A pressure sensing transducer 53 is positioned in the pipe 27 at the intake 25 to the booster pump 21. An electrical signal proportional to pressure is communicated by a circuit 55 with the control circuits 47. Similarly, another pressure sensing transducer 57 is provided in the pipe 33 at the discharge 31 of the booster pump 21. Its electrical signal proportional to pressure is communicated over a circuit 59 to the control circuits 47.

Figure 2:
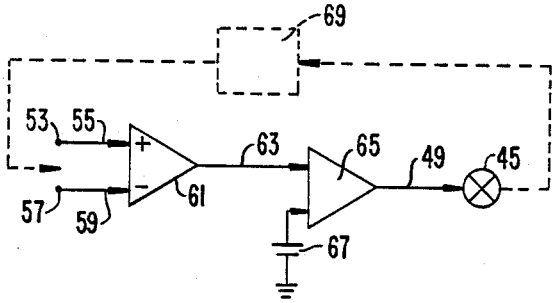
FIG. 2 is a circuit diagram that shows the operation of a portion of the system of FIG. 1.

The control circuits 47 function in a manner illustrated in FIG. 2 to control the bypass valve 45. An anolog differential amplifier 61 receives as inputs the signals from the booster pump pressure transducers 53 and 57. Its output in a circuit 63 is an electrical signal representative of the difference in pressure between the intake and discharge of the booster pump 21. That signal is then compared by a comparator amplifier 65 with a fixed voltage 67. The voltage 67 is equal to that voltage difference in the circuits 55 and 59 that exist when the booster pump 21 is operating at its maximum permissible differential pressure. Therefore, an output of the comparator 65 in the circuit 49 is an "error" signal that tends to drive the valve 45 to a position that causes the booster pump to operate at that maximum permitted differential pressure. The effect of altering the amount of opening in the valve 45 is to cause a correction of the differential pressure across the booster pump 21 through controlling the effective size of the bypass 43. This is a servo control system having a feedback loop, indicated at 69 in dotted outline in FIG. 2, that causes the differential pressure to change. Of course, the functions illustrated in FIG. 2 to be carried out by an analog control circuit can alternatively be accomplished digitally under the control of a microprocessor.

The control circuits 47 also operate the roughing valve 29. A signal in circuit 71 tells the valve 29 to open or close, and a signal in a circuit 73 is optionally provided to confirm to the control circuits 47 the actual position of the valve 49. Also, a pressure transducer 75 is provided within the load lock chamber 71. A signal in a circuit 77 tells the control circuits 47 the level of pressure within the chamber 11.

FIGS. 3(A) through 3(E) refer to a preferred operation of the system of FIG. 1 to evacuate the load lock chamber 11 from atmospheric pressure to a processing pressure. In this example, at an initial time t1, the pressure within the chamber 11 is at atmosphere, as illustrated in FIG. 3(C). Both the booster pump 21 and the mechanical pump 23 are operating, but the roughing valve 29 is closed, as indicated by FIG. 3(A). The bypass valve 45 is opened, as indicated by FIG. 3(B).

At a later time t2, after it is assured that these desired initial conditions exist, the roughing valve 29 is opened, as indicated by FIG. 3(A). The roughing valve 29 remains fully open for the duration of the evacuation. The bypass valve 45, however, is gradually closed, in a manner indicated in FIG. 3(B), in order to maintain the differential pressure across the booster pump 21 at or very near the maximum permitted level, as shown in FIG. 3(D). Because of transient conditions when the roughing valve 29 is first opened, operation of the bypass valve 45 is delayed for a short time, such as one second or so, before the control circuits 47 allow it to operate to close in a manner that maintains the differential pressure across the booster pump near its maximum level. Depending upon the specific equipment and instruments employed, such a delay may inherently result and thus no additional delay is introduced in this case. The result of this type of control is to evacuate the chamber 11 in the shortest possible time with the given pump and piping sizes.

To the extent that existing booster pumps employ a valved bypass path, the nature of the baypass valve and its operation result in the differential pressure across the pump being the maximum allowable for only a short time during the interval between time t2 and t5. Those systems work the booster pump at its maximum potential for only part of this critical time, thus taking as significantly longer time to evacuate the chamber 11.

At time t4, the bypass valve has completely closed so that the bypass 43 is not contributing to equalize pressure between the intake and discharge of the booster pump 21. By that time, the pressure in the chamber 11 has been reduced to a sufficient level so that the bypass is not necessary. Evacuation of the chamber 11 continues, however, until time t6. As indicated by FIG. 3(C), it is at that time that the chamber 11 has been reduced in pressure to its desired operating pressure. Thus, as indicated by FIG. 3(A), the roughing valve 29 is closed at or shortly after the time t6. The load lock chamber 11 is then sealed from the atmosphere so that the load lock valve 15 may be opened to pass articles between the chambers 11 and 17. Alternative to sealing off the chamber 11 by closing the roughing valve 29, for some specific applications, the pumps 21 and 23 can continue to operate through a diffusion pump that is directly connected to the chamber 11.

Throughout the evacuation of the chamber 11, both of the pumps 21 and 23 are driven at substantially a uniform speed by their motor sources 39 and 41, respectively. This is illustrated for the booster pump 21 by FIG. 3(E). No fluid or other coupling with slippage is provided between a pump and its driving motor source. Further, the motors are sized to be large enough to drive the pump at a substantially uniform speed under varying load conditions, thereby additionally speeding up the evacuation of the chamber 11.

A preferred type of bypass valve 45 is a poppet valve that is pneumatically operated in response to the control signals. Alternative types of valves that can be used include a servo motor controlled butterfly, gate or other type of proportionally adjustable valve. Each of the pressure transducers 53 and 57 may be chosen from available absolute pressure sensors. Alternatively, a differential capacity monometer can be used to develop a signal proportional to the difference in pressure across the booster pump 21.

Figure 3:
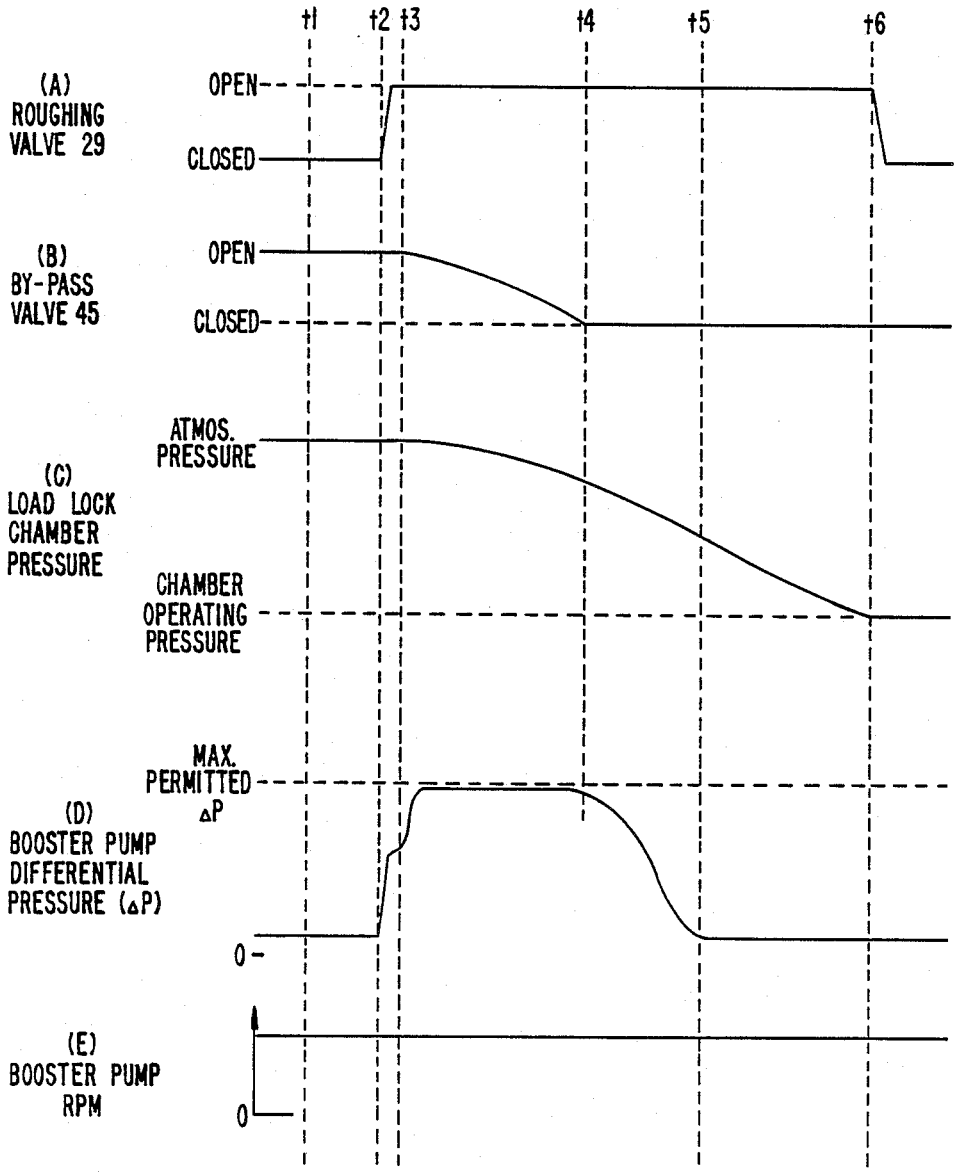
FIGS. 3(A) through 3(E) are curves that illustrate the operation of the pumping system of FIGS. 1 and 2.
Figure 4A:
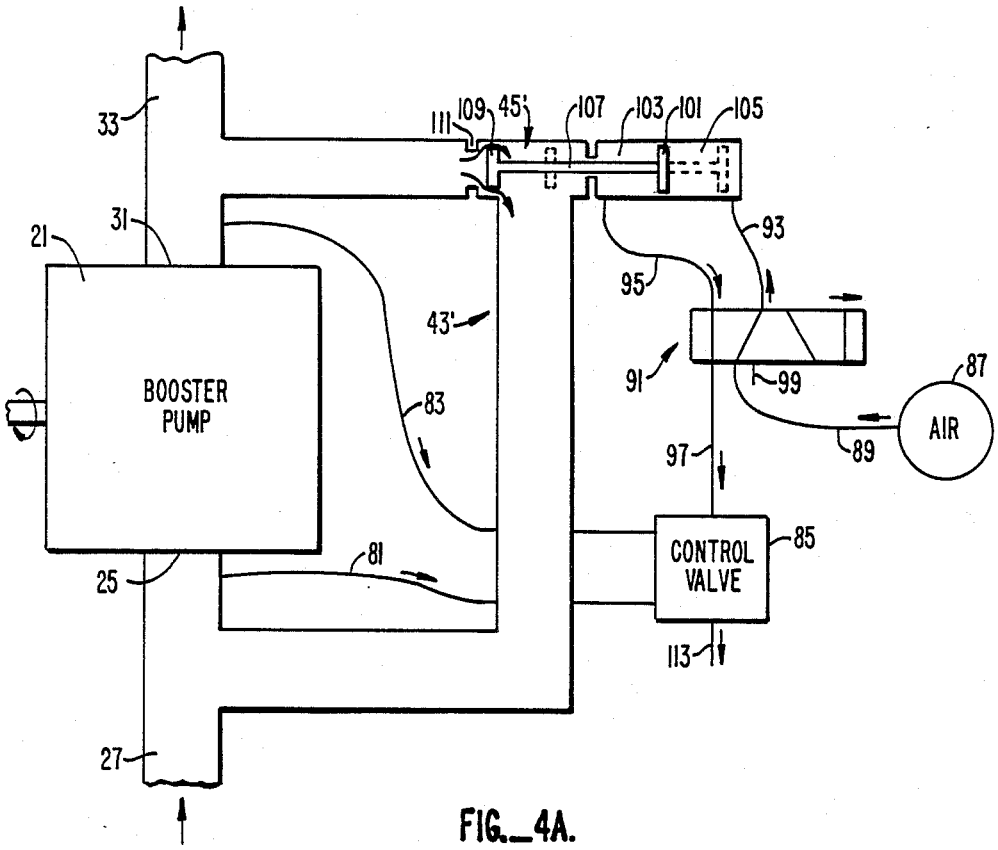
FIG. 4(A) schematically illustrates a modification of the pumping system shown in FIG. 1.
Figure 4B:
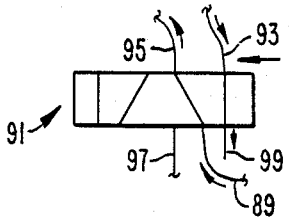
FIG. 4(B) shows a portion of the modified system of FIG. 4(A) with valve thereof in a different position.
Figure 5:
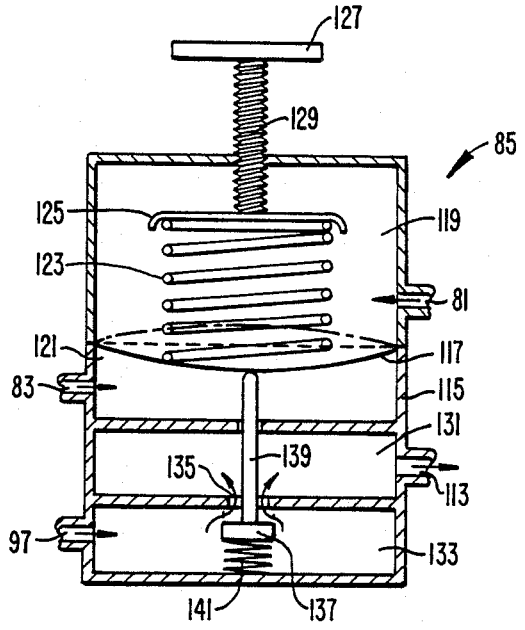
FIG. 5 is an example of the control valve of the modified system of FIG. 4(A).

As an alternative to the electronic control embodiment just described, the various aspects of the present invention may also be implemented by a second embodiment that utilizes a pneumatic control system in place of the electronic one. An example of such a system is illustrated in FIGS. 4(A), 4(B) and 5. A principal advantage of the pneumatic control example of these figures over the electronic control system example described in FIGS. 1–3 is that the pneumatic system is less complex and less expensive to implement.

FIG. 4(A) shows a portion of the system of FIG. 1, with the same reference numbers being applied to identify the same elements. For those elements of FIG. 4(A) which are somewhat equivalent in function of those of FIG. 1 but different in specific structure or operation, the same reference numbers are used with a prime (') added. The bypass path 43' around the booster pump 21 of FIG. 4(A) includes a proportionately adjustable poppet valve 45'. The poppet valve 45' can also be used as the bypass valve 45 in the system of FIG. 1, with a pneumatic system that drives it between open and closed positions in response to an electronic pressure difference signal. But in the example of FIG. 4(A), the pressure differential across the booster pump 21 is pneumatically sensed by air tubes 81 and 83 connected respectively between the intake 25 and the discharge 31 of the booster pump and a control valve 85. A source 87 provides, through an air line 89, a source of air pressure greatly in excees of that of normal atmospheric pressure. This source of air pressure is connected by a solenoid controlled valve 91 to the bypass valve 45' through either an air line 93 or air line 95. In the position illustrated in FIG. 4(A), the valve 91 causes the air line 89 to be connected to the air line 93. The valve 91 has a second position that is illustrated in FIG. 4(B), wherein the air pressure supply line 89 is connected to the air line 95. Also selectively connected by the valve 91 is an air line 97 extending between it and the control valve 85, and an air line 99 which is open at its free end to the atmosphere.

The example bypass valve 45' shown in FIG. 4(A) includes a driving piston 101 that is sealed to the internal walls of a piston chamber, and able to slide therealong, thereby dividing the piston chamber into two portions 103 and 105. A shaft 107 passes through a wall of the piston chamber and is sealed with it. A valve element 109 is provided at an end of the rod 107 opposite to the piston 101. It is designed to close off the bypass passage 43' when moved into contact with a valve seat 111 within that passage. The valve structure is movable from such a closed position (not shown) to a fully opened position that is shown in FIG. 4(A) in dotted outline.

In operation, the solenoid control valve 91 is initially positioned as shown in FIG. 4(B). In this position, the source of air pressure in the air line 89 is connected through the air line 95 to the portion 103 of the piston chamber. The other portion 105 of the piston chamber is, at the same time, vented to the atmosphere through the air line 99. This causes the valve to move to its fully opened position as shown in dotted outline in FIG. 4(A). The position of the valve 91 in FIG. 4(B) is preferably caused to be the rest position; that is, a spring-loaded position taken in the absence of any electrical energy applied to a controlling solenoid (not shown). The application of such energy causes the valve to move into its position shown in FIG. 4(A).

The system of FIG. 4(A) operates with substantially the same characteristic curves as previously described with respect to FIG. 3. In this case, the valve 91 is caused to move from the initial position shown in FIG. 4(B) to that shown in FIG. 4(A) at about time t3, by energizing its driving solenoid. From the time t3 onward, the valve 91 remains in the position of FIG. 4(A).

In that position, the air pressure from the source 87 is directed into the portion 105 of the piston chamber that tends to urge the piston 101 in a direction to close the bypass valve 45'. But this occurs in a controlled way since the piston chamber portion 103 is connected through the air lines 95 and 97, and through the valve 91, to a control valve 85. The control valve 85 pneumatically operates to slowly exhaust to the atmosphere through an air line 113 the air within the piston chamber 103, thus causing the valve to slowly close. The control valve 85 does so in a manner to maintain the differential pressure across the booster pump 21 at or slightly below its maximum permitted value during the evacuation, in accordance with the curve of FIG. 3(D). The result is the evacuation of the load lock chamber 11 (FIG. 1) in a manner illustrated in the curve of FIG. 3(C).

Referring to FIG. 5, a cross-sectional representation of a preferred control valve 85 is described. A case 115 forms a first air-tight chamber divided by a diaphragm 117 into chamber portions 119 and 121. The shape of the diaphragm 117 depends upon the differential air pressure in the chambers 119 and 121 on its opposite sides. The chamber portion 119 receives the booster pump intake pressure and the chamber 121 receives the booster pump discharge pressure. The differential booster pump pressure is thus converted to a position of the diaphragm 117. The diaphragm 117 is also mechanically biased by a spring 123 held in compression between the diaphragm 117 and a plate 125. The plate 125 is adjustable in a direction toward and away from the diaphragm upon rotation of a handle 127 that is attached to a threaded shaft 129 with respect to a top portion of the case 115. Thus, the amount of compression of the spring 123 is asdjustable by hand, thus adjusting the amount of bias force that is applied to the diaphragm 117. This also allows setting the maximum booster pump differential pressure that is desired not to be exceeded.

Two other chambers 131 and 133 are provided with an opening 135 therebetween. That opening is sealable by a valve 137 having a valve stem 139. The valve and valve stem are urged upward in contact with the diaphragm 117 by a soft spring 141. Thus, as the diaphragm 117 moves in response to a changing booster pump differential pressure, the position of the valve 137 can alter the amount of air that can pass between the chambers 133 and 131. Thus, the rate at which the air pressure is bled from the bypass valve piston portion 103 (FIG. 4(A)) is controlled. As the differential pressure increases, the diaphragm 117 moves upward, as indicated by two alternative positions shown in dashed outline in FIG. 5. As the differential pressure drops, the diaphragm 117 moves downward which results in the valve 137 opening, causing the bypass valve 45' to close somewhat, thereby increasing the differentiasl pressure that is applied to the diaphragm 117. This is a pneumatic servo-control loop.

Although the various aspects of the present invention have been described with respect to its preferred embodiments, it will be understood that the invention is entitled to protection within the full scope of the appended claims.

It is claimed:

1. A method of evacuating an enclosed chamber through a tandem connection of a booster pump and a mechanical pump, comprising the steps of:

commencing pumping gas from said enclosed chamber by operating both of the booster and mechanical pumps, from the beginning os said pumping, providing a gas bypass around the booster pump, and as the gas pressure of the enclosed chamber drops, gradually closing off said bypass at a rate to maintain a pressure differential across said booster pump substantially at a given value until the bypass path is completely closed.

2. A method of evacuating a chamber initially at atmospheric pressure with a pumping system of a type including a booster pump having an inlet operably connected through a roughing valve to an interior of said chamber and a discharge connected to an intake of a mechanical pump, and a gas bypass path extending from the inlet to the discharge of said booster pump and having a valve therein, comprising the steps of:

running said booster and mechanical pumps, opening the bypass path valve a maximum amount, opening said roughing valve, closing the bypass valve a partial amount until a difference in gas pressure between the inlet and discharge of the booster pump is a given value, continuing to incrementally close the bypass valve in a manner to maintain the difference in pressure between the booster pump inlet and its discharge substantially at said given value until said bypass valve is fully closed, and continuing to drive said booster and mechanical pumps until the chamber is evacuated to a desired gas pressure level.

3. The method according to claim 2 wherein said booster pump is driven substantially at a constant speed during the evacuation of said chamber.

4. The method according to claim 2 wherein the step of closing the bypass valve commences at approximately 1 second after the step of opening the roughening valve has been completed.

5. The method according to claim 2 wherein the booster pump is driven continuously from prior to the step of opening the bypass valve and until after the step of completely closing the bypass valve.

6. The method according to claim 2 wherein the step of continuing to close the bypass valve includes the following steps automatically accomplished with electronic circuits and transducers:

monitoring the gas pressure in each of the inlet and discharge of the booster pump and developing individual electrical signals proportional to said pressures, processing said electrical signals in order to develop a signal proportional to the difference in pressure at the booster pump inlet and discharge, comparing said pressure difference signal with a fixed reference signal proportional to a maximum desired pressure differential across the booster pump, and closing the bypass valve at a rate to maintain a difference between the differential pressure signal and said desired signal at substantially zero until the bypass valve is completely closed.

7. The method according to claim 2 wherein the step of continuing to close the bypass valve includes the following step automatically accomplished with a pneumatic system:

urging the bypass valve toward a closed position by forcing a piston attached to said valve against a confined volume of air, controllably venting said confined volume of air to the atmosphere through a control valve, and controlling the rate of venting by said control valve in response to the booster pump differential pressure as detected by pneumatic lines connected therewith.

8. Apparatus for evacuating gas from an enclosed chamber that is repeatedly opened to the atmosphere in order to gain access to the chamber, comprising:

an evacuation passage provided to said chamber from its outside, means including a roughing valve in said passage for controllably opening and closing said evacuation passage, a booster pump having an intake connected to said evacuation passage and having a discharge, a mechanical pump having an intake connected to the discharge of the booster pump, a gas bypass path around said booster pump from its said intake to its said discharge, a proportionally controlable valve in said bypass path, and means responsive to a difference between the booster pump intake and discharge gas pressure for controlling the amount of opening of said proportionally controlled valve in a manner that maintains that gas pressure difference below a predetermined threshold.

9. Apparatus according to claim 8 wherein said proportionally controlled valve controlling means comprises:

means installed adjacent to the intake of said booster pump for providing a first electrical signal proportional to the gas pressure at said inlet, means provided within the discharge of said booster pump for providing a second electrical signal that is proportional to the gas pressure within said discharge, and means receiving said first and second signals for developing a third signal that is proportional to the difference between the booster pump intake and discharge gas pressures, said controlling means operating in response to said third electrical signal.

10. Apparatus according to claim 8 wherein said proportionally controlled valve controlling means comprises:

means mechanically connected to said proportionally controllable valve and including a piston for tending to urge said valve toward a closed position by forcing the piston against a confined volume of air, a control valve operable to open said confined air volume to the atmosphere, and means including direct air connection with the intake and discharge of the booster pump for causing said control valve to open in response to said gas pressure difference across the booster pump falling below said predetermined threshold.

* * * * *